US012637312B2

(12) United States Patent
Yoshida

(10) Patent No.: US 12,637,312 B2
(45) Date of Patent: May 26, 2026

(54) BELT CONVEYOR DEVICE AND IMAGE FORMING APPARATUS

(71) Applicant: KYOCERA Document Solutions Inc., Osaka (JP)

(72) Inventor: Takeshi Yoshida, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 96 days.

(21) Appl. No.: 18/763,085

(22) Filed: Jul. 3, 2024

(65) Prior Publication Data

US 2025/0011114 A1 Jan. 9, 2025

(30) Foreign Application Priority Data

Jul. 7, 2023 (JP) ..... 2023-112069

(51) Int. Cl.
*B65H 5/02* (2006.01)

(52) U.S. Cl.
CPC ..... *B65H 5/021* (2013.01); *B65H 2404/255* (2013.01); *B65H 2801/06* (2013.01)

(58) Field of Classification Search
CPC ..... B65H 2404/2693; B65H 2404/255; B65G 39/16
See application file for complete search history.

(56) References Cited

U.S. PATENT DOCUMENTS 7,986,903 B2 * 7/2011 Park ..... G03G 15/161 399/121
2015/0227089 A1 * 8/2015 Hozumi ..... G03G 15/1615 198/806
2022/0019159 A1 * 1/2022 Kainuma ..... G03G 15/161

FOREIGN PATENT DOCUMENTS

JP 2019-070694 A 5/2019

* cited by examiner

*Primary Examiner* — Howard J Sanders
(74) *Attorney, Agent, or Firm* — Stein IP, LLC

(57) ABSTRACT

The belt conveyor device includes an endless belt, a pair of biasing members, a pair of tension arms, and a correction mechanism. The pair of biasing members bias a tension roller in such a direction as to heighten tension of the belt. The pair of tension arms retain the tension roller and the pair of biasing members, and are swingably supported by a pair of arm support portions of the casing. The pair of biasing members bias a shaft portion of the tension roller in such a direction as to make the shaft portion farther from the pair of arm support portions. The arm support portions are placed above the shaft portion of the tension roller.

4 Claims, 11 Drawing Sheets

BELT CONVEYOR DEVICE AND IMAGE FORMING APPARATUS

INCORPORATION BY REFERENCE

This application is based on and claims the benefit of priority from Japanese Patent Application No. 2023-112069 filed on Jul. 7, 2023, the contents of which are hereby incorporated by reference.

BACKGROUND

The present disclosure relates to a belt conveyor device and an image forming apparatus.

Belt conveyor devices are known as a constituent element of image forming apparatuses such as copiers and printers. A belt conveyor device is equipped with endless belts including, for example, an intermediate transfer belt to which toner images of different colors formed by a plurality of photosensitive drums are primarily transferred successively in superimposition and from which the resulting toner image is secondly transferred onto a paper sheet, as well as a conveyor belt for conveying the sheet in a sucked-up state.

With those belt conveyor devices, there has been a problem that the belt may deviate in an axial direction of rollers on which the belt is turnably stretched, resulting in a meander of the belt. Against this problem, a technique has been proposed to halt the meander of the belt by adjusting alignment of the rollers.

SUMMARY

A belt conveyor device according to one aspect of the present disclosure includes a casing, an endless belt, a plurality of rollers, a pair of biasing members, a pair of tension arms, and a correction mechanism. The plurality of rollers are rotatably supported by the casing, and allow the belt to be turnably stretched thereon. The pair of biasing members bias a tension roller out of the plural rollers in such a direction as to heighten tension of the belt. The pair of tension arms are swingably supported by the casing to retain the tension roller and the pair of biasing members. The correction mechanism corrects meanders of the belt relative to the rollers. The correction mechanism includes a pair of inclined bearings and a pair of main-body guides. The pair of inclined bearings include a pair of bearing portions for bearing a shaft portion of the tension roller, and a pair of inclined portions that are inclined symmetrically with respect to an axial direction of the tension roller, where the pair of inclined bearings rotatably support the shaft portion of the tension roller, and are movable in the axial direction. The pair of main-body guides are put into contact with the pair of inclined portions, and make an end portion of the tension roller in the axial direction moved in a direction perpendicular to the axial direction, together with the pair of inclined bearings that are moved in the axial direction by meandering of the belt. The pair of tension arms are swingably supported by the pair of arm support portions formed in the casing. The pair of biasing members bias the shaft portion of the tension roller in such a direction as to make the shaft portion farther from the pair of arm support portions. The arm support portions are placed above the shaft portion of the tension roller.

DETAILED DESCRIPTION

Hereinafter, an embodiment of the present disclosure will be described with reference to the accompanying drawings. It is noted that the disclosure is not limited to contents of the following description.

Figure 1:
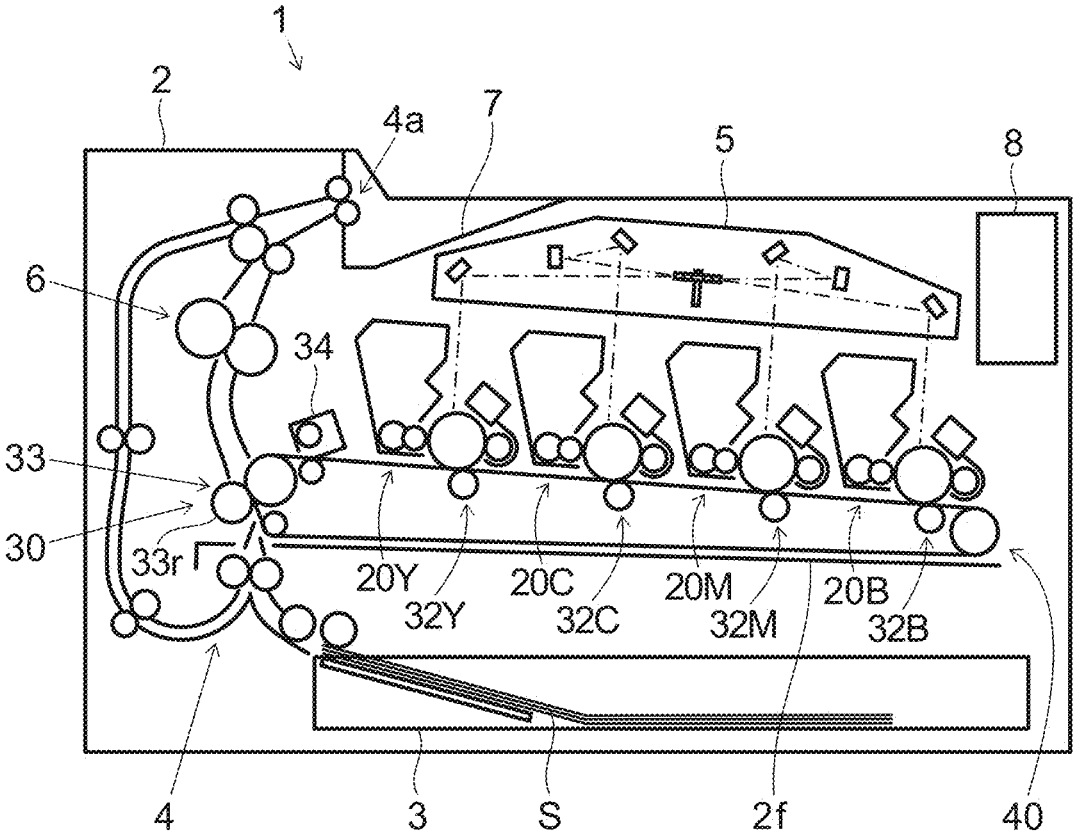
FIG. 1 is a schematic cross-sectional front view of an image forming apparatus according to one embodiment of the present disclosure.
Figure 2:
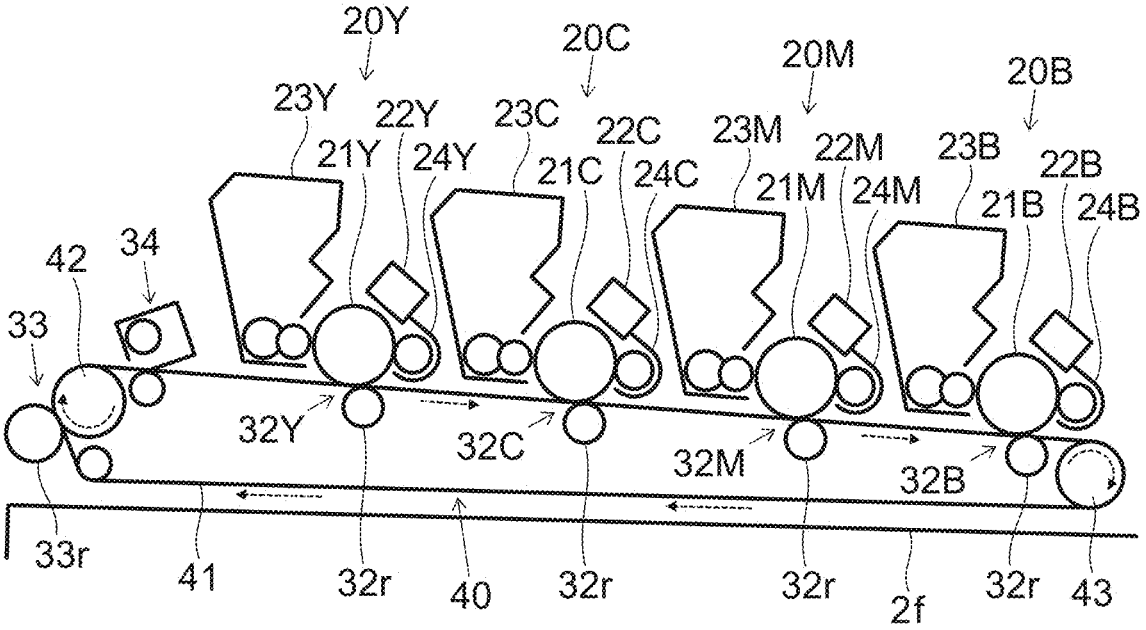
FIG. 2 is a schematic cross-sectional front view of around a belt conveyor device in the image forming apparatus of FIG. 1.

FIG. 1 is a schematic cross-sectional front view of an image forming apparatus 1 according to one embodiment. FIG. 2 is a schematic cross-sectional front view of around a belt conveyor device in the image forming apparatus 1 of FIG. 1. An example of the image forming apparatus 1 of this embodiment is a tandem-type color printer which accepts print-job-related image data and print instructions from external computers and which transfers toner images onto a paper sheet S with use of an intermediate transfer belt 41. The image forming apparatus 1 may instead be, for example, a so-called multifunction peripheral equipped with printing, scanning (image reading), facsimile transmission, and other functions.

The image forming apparatus 1, as shown in FIGS. 1 and 2, includes, as provided in its housing 2, a sheet feed part 3, a sheet conveyance part 4, an exposure part 5, an image forming part 20, a transfer part 30, a fixing part 6, a sheet discharge part 7, and a controller 8.

The sheet feed part 3 is placed at a bottom portion in the housing 2. The sheet feed part 3, having a plurality of unprinted sheets (recording medium) S contained therein, separates and feeds out sheets S one by one on occasions of printing. The sheet conveyance part 4 extends vertically along a side wall of the housing 2. The sheet conveyance part 4 conveys the sheet S, which has been fed out from the sheet feed part 3, to a secondary transfer part 33 and the fixing part 6, and further discharges the fixing-processed sheet S through a sheet discharge port 4*a* to the sheet discharge part 7. The exposure part 5 is placed at an upper portion in the housing 2. The exposure part 5 emits laser light, which has been controlled based on image data, toward the image forming part 20.

The image forming part 20 is placed below the exposure part 5 and above the intermediate transfer belt 41. The image forming part 20 includes a yellow-destined image forming part 20Y, a cyan-destined image forming part 20C, a magenta-destined image forming part 20M, and a black-destined image forming part 20B. These four image forming parts 20 are identical in basic configuration. Therefore, unless otherwise needed to be particularly restricted, identification signs of 'Y', 'C', 'M' and 'B' representing individual colors may be omitted in the following description.

Each image forming part 20 includes a photosensitive drum 21 supported rotatable in a specified direction (counterclockwise in FIGS. 1 and 2). Around the photosensitive drum 21, the image forming part 20 further includes a charging part 22, a developing part 23, and a drum cleaning part 24 which are placed along a rotational direction of the photosensitive drum 21. In addition, a primary transfer part 32 is placed between the developing part 23 and the drum cleaning part 24.

The photosensitive drum 21 has a photosensitive layer formed on its outer circumferential surface. The charging part 22 electrically charges the outer circumferential surface of the photosensitive drum 21 to a specified surface potential. The exposure part 5 exposes to light the outer circumferential surface of the photosensitive drum 21 charged by the charging part 22 so that an electrostatic latent image of an original image with its charging level attenuated is formed on the outer circumferential surface of the photosensitive drum 21. The developing part 23 feeds toner to the electrostatic latent image on the outer circumferential surface of the photosensitive drum 21, followed by its development to form a toner image. The four image forming parts 20 form toner images of different colors, respectively. After the toner image is primarily transferred to an outer circumferential surface of the intermediate transfer belt 41, the drum cleaning part 24 removes and collects toner or other deposits remaining on the outer circumferential surface of the photosensitive drum 21. In this way, the image forming part 20 forms an image (toner image) which is to be later transferred onto the sheet S.

The transfer part 30 includes a belt conveyor device 40, primary transfer parts 32Y, 32C, 32M, 32B, a secondary transfer part 33, and a belt cleaning part 34. The belt conveyor device 40 is placed below the four image forming parts 20 and above the sheet feed part 3.

The belt conveyor device 40 includes an intermediate transfer belt 41 supported turnable in a specified direction (counterclockwise in FIGS. 1 and 2). The intermediate transfer belt 41 is an endless intermediate transferer to which toner images formed on the outer circumferential surfaces of the photosensitive drums 21 in the four image forming parts 20, respectively, are primarily transferred successively in superimposition. The four image forming parts 20 are disposed in a so-called tandem type in line from upstream toward downstream side in a turning direction of the intermediate transfer belt 41.

The primary transfer parts 32Y, 32C, 32M, 32B are placed under the individual-color image forming parts 20Y, 20C, 20M, 20B, respectively, with the intermediate transfer belt 41 pinched therebetween. The secondary transfer part 33 is placed upstream of the fixing part 6 in a sheet conveyance direction of the sheet conveyance part 4, as well as downstream of the four image forming parts 20Y, 20C, 20M, 20B in the turning direction of the intermediate transfer belt 41. The belt cleaning part 34 is placed downstream of the secondary transfer part 33 in the turning direction of the intermediate transfer belt 41.

Each primary transfer part 32 transfers a toner image, which has been formed on the outer circumferential surface of the photosensitive drum 21, onto the outer circumferential surface of the intermediate transfer belt 41. In other words, the toner image is primarily transferred onto the outer circumferential surface of the intermediate transfer belt 41 at the individual-color primary transfer parts 32Y, 32C, 32M, 32B. Then, by the toner images of the four image forming parts 20 being transferred to the intermediate transfer belt 41 successively in superimposition at specified timings along with the turning of the intermediate transfer belt 41, a color toner image in which four-color toner images of yellow, cyan, magenta and black have been superimposed together is formed on the outer circumferential surface of the intermediate transfer belt 41.

The color toner image on the outer circumferential surface of the intermediate transfer belt 41 is transferred onto the sheet S fed in synchronization by the sheet conveyance part 4 at a secondary transfer nip portion formed in the secondary transfer part 33. The belt cleaning part 34 removes toner and other deposits remaining on the outer circumferential surface of the intermediate transfer belt 41 after secondary transfer, fulfilling the cleaning function. In this way, the transfer part 30 transfers (records) the toner image, which has been formed on the outer circumferential surface of the photosensitive drum 21, onto the sheet S.

The fixing part 6 is placed upward of the secondary transfer part 33. The fixing part 6 heats and pressurizes the sheet S, onto which the toner image has been transferred, so as to fix the toner image on the sheet S.

The sheet discharge part 7 is placed upward of the transfer part 30. The sheet S, on which the toner image has been fixed and for which printing is over, is conveyed to the sheet discharge part 7. The sheet discharge part 7 allows an after-printing sheet (printed matter) to be taken out from upward.

The controller 8 includes a CPU, an image processing part, a storage part, and other electronic circuits and electronic components (none shown). The CPU, based on control programs and data stored in the storage part, controls operations of the individual component elements provided in the image forming apparatus 1 to execute processing related to functions of the image forming apparatus 1. The sheet feed part 3, the sheet conveyance part 4, the exposure part 5, the image forming part 20, the transfer part 30, and the fixing part 6 receive instructions individually from the controller 8 to fulfill printing on the sheet S in linkage with one another. The storage part is made up from a combination of nonvolatile storage devices such as program ROM (Read Only Memory) or data ROM, and volatile storage devices such as RAM (Random Access Memory).

Figure 3:
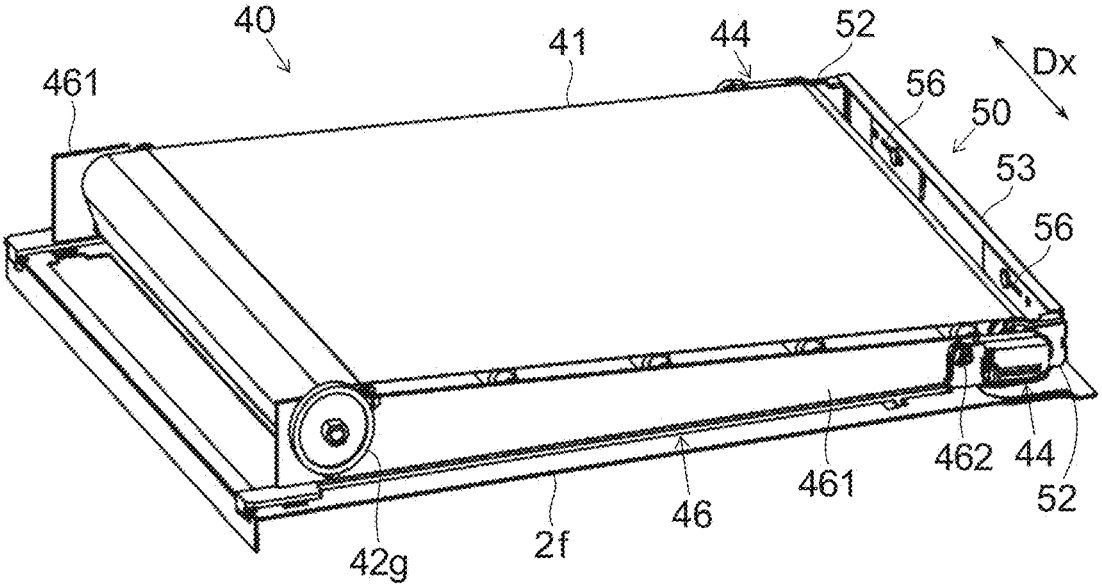
FIG. 3 is a perspective view of the belt conveyor device of FIG. 2.
Figure 4:
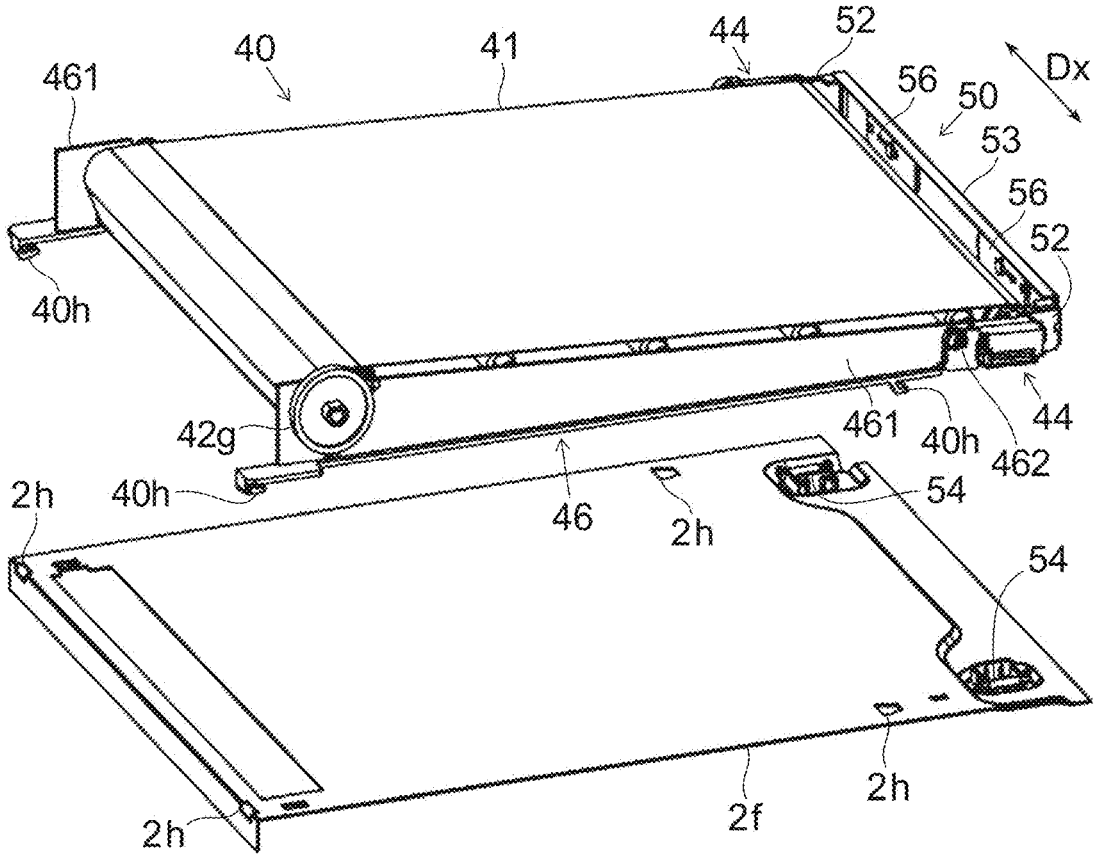
FIG. 4 is a perspective view of the belt conveyor device of FIG. 3, showing a state in which the belt conveyor device has been removed from an intermediate frame.
Figure 5:
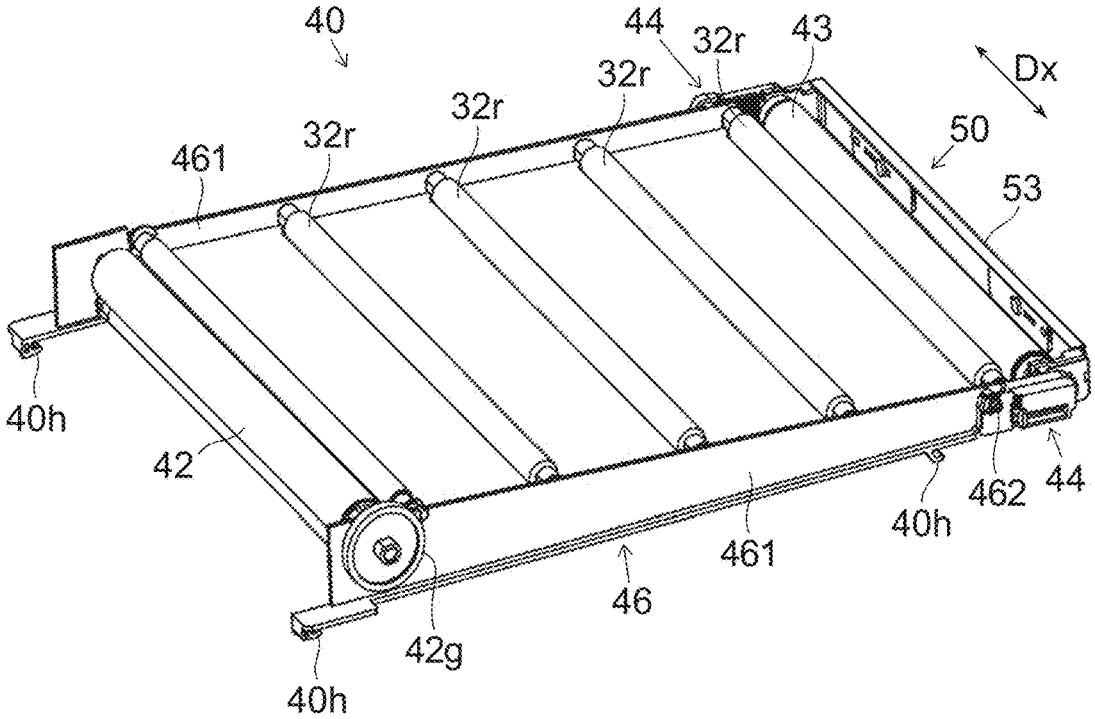
FIG. 5 is a perspective view of the belt conveyor device of FIG. 3, showing a state in which an intermediate transfer belt has been removed.
Figure 6:
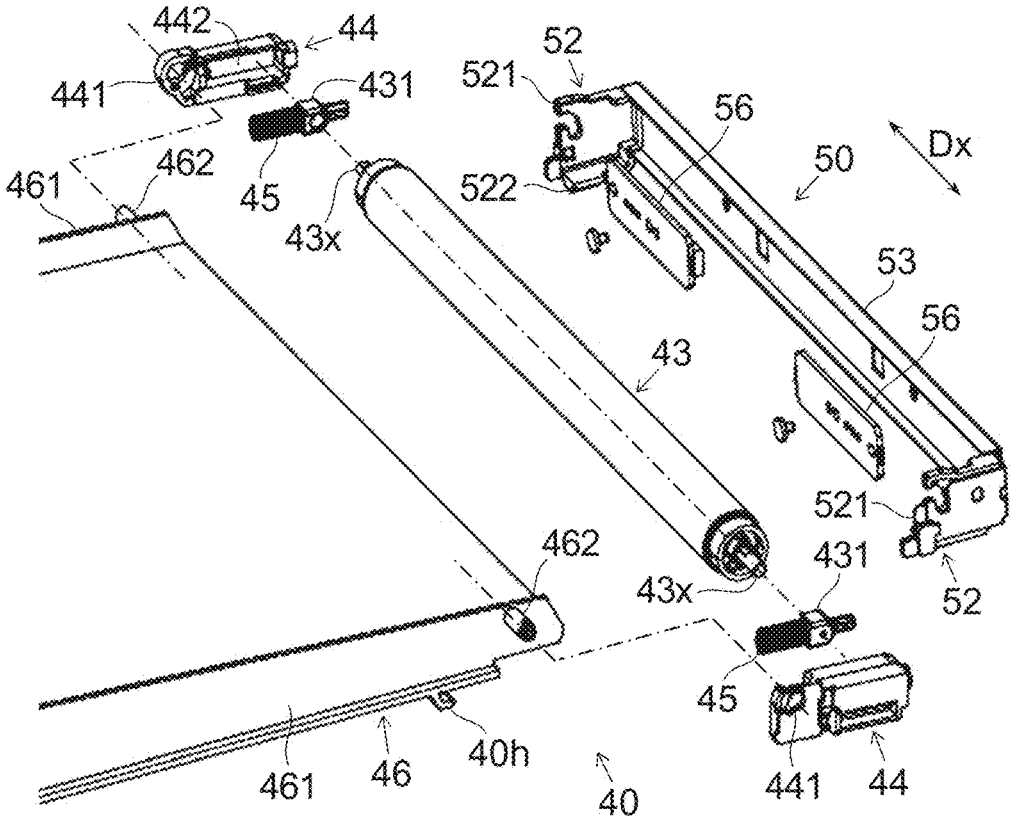
FIG. 6 is an exploded partial perspective view of around a tension roller of FIG. 5.
Figure 7:
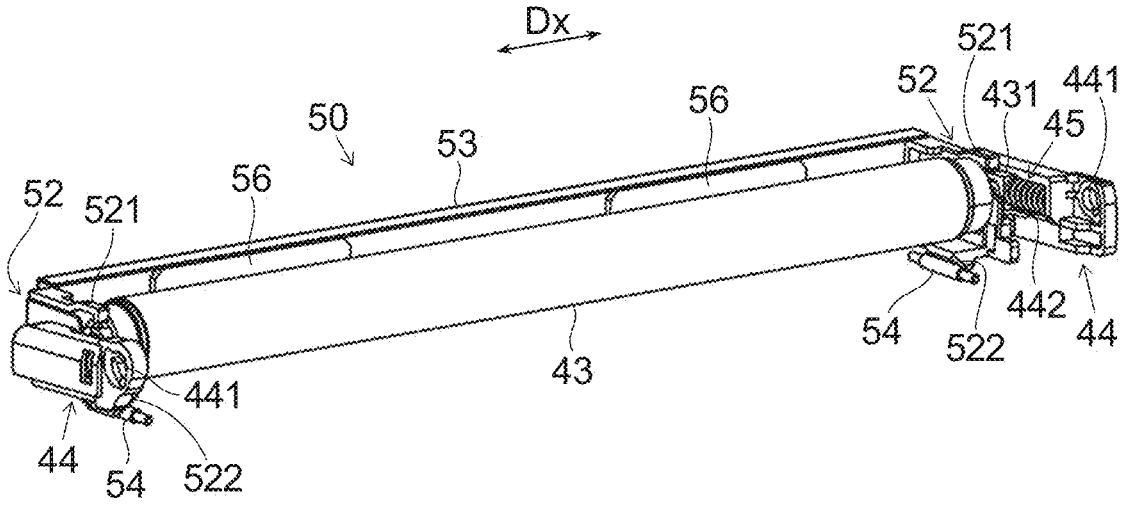
FIG. 7 is a partial perspective view of around the tension roller of FIG. 5.
Figure 8:
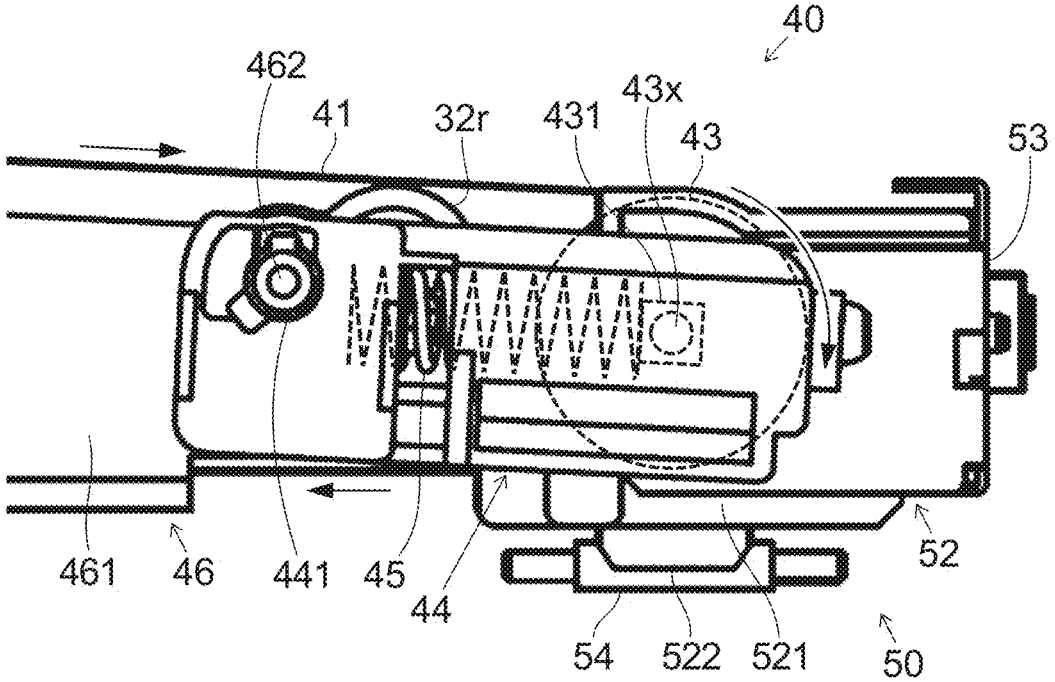
FIG. 8 is a partial front view of around the tension roller of FIG. 3.
Figure 9:
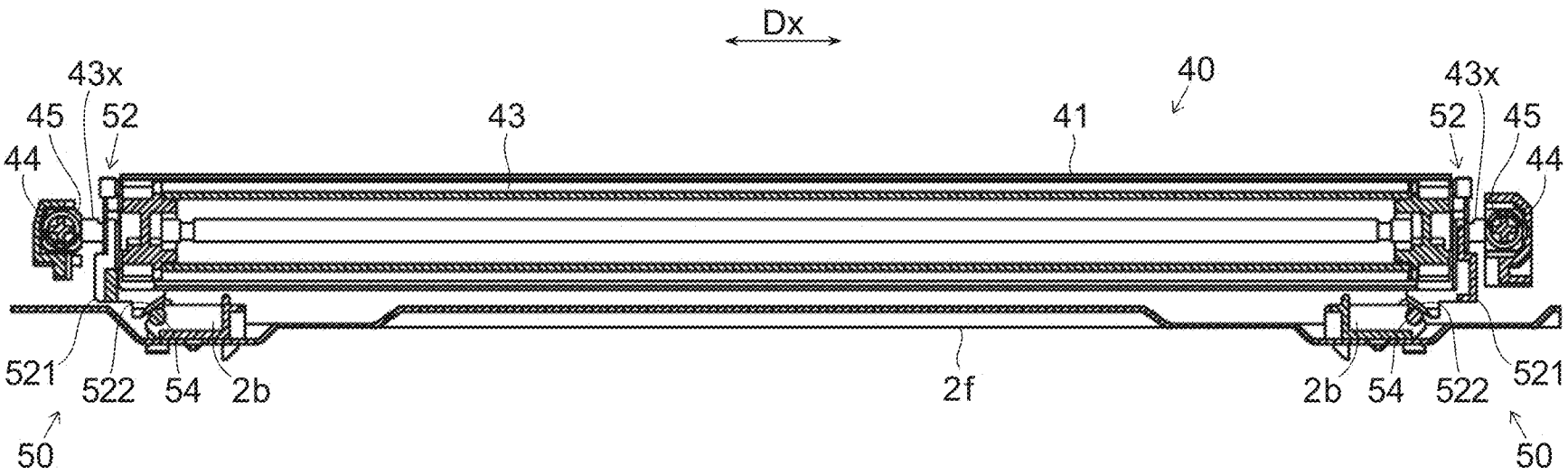
FIG. 9 is a cross-sectional side view of the belt conveyor device of FIG. 3.

Next, a description is given on the configuration of the belt conveyor device 40 with reference to FIG. 2 as well as FIGS. 3 to 9. FIG. 3 is a perspective view of the belt conveyor device 40 of FIG. 2. FIG. 4 is an exploded perspective view of the belt conveyor device 40 of FIG. 3, showing a state in which the belt conveyor device 40 has been removed from an intermediate frame 2*f*. FIG. 5 is a perspective view of the belt conveyor device 40 of FIG. 3, showing a state in which the intermediate transfer belt 41 has been removed. FIGS. 6, 7, and 8 are an exploded partial perspective view, a partial perspective view, and a partial front view, respectively, of around a tension roller 43 of the belt conveyor device 40 of FIG. 5. FIG. 9 is a cross-sectional side view of the belt conveyor device 40 of FIG. 3. It is noted that an axial direction Dx of the tension roller 43 is indicated by arrows in FIG. 3 and following. In FIG. 6, individual component elements are depicted as exploded sideways of the belt conveyor device 40.

As shown in FIG. 2, the belt conveyor device 40 is placed along and below the four image forming parts 20Y, 20C, 20M, 20B. Also, as shown in FIGS. 2, 3 and 4, the belt conveyor device 40 is placed above the plate-shaped, generally horizontally extending intermediate frame 2*f*, which is provided in the housing 2.

The belt conveyor device 40 is formed into a generally rectangular parallelepiped shape which extends generally horizontally. Four hooks 40*h* are provided at bottom portions, respectively, of the belt conveyor device 40. The intermediate frame 2*f* has four openings 2*h* extending through and vertically opposed to the four hooks 40*h*, respectively, of the belt conveyor device 40. Inserting and hooking the hooks 40*h* into the openings 2*h*, respectively, allows the belt conveyor device 40 to be removably fitted to the intermediate frame 2*f*.

The belt conveyor device 40 includes the intermediate transfer belt 41, a driving roller 42, the tension roller 43, a pair of tension arms 44, and a pair of tension springs (biasing members) 45.

The intermediate transfer belt 41 is an endless belt turnably stretched over a plurality of rollers. These plural rollers, in this embodiment, include the driving roller 42 and the tension roller 43. Rotational axes of the driving roller 42 and the tension roller 43 are parallel to a rotational axis of the photosensitive drum 21, and extend in a drawing-sheet depthwise direction of FIG. 2.

In the belt conveyor device 40, primary transfer rollers 32*r* are placed below the four image forming parts 20Y, 20C, 20M, 20B, respectively, with the intermediate transfer belt 41 interposed therebetween. The four primary transfer rollers 32*r* are set at positions opposed to the photosensitive drums 21, respectively, with the intermediate transfer belt 41 pinched therebetween while the primary transfer rollers 32*r* keep in contact with the inner circumferential surface of the intermediate transfer belt 41. The driving roller 42, the tension roller 43, and the four primary transfer rollers 32*r* are each rotatably supported by side plates 461 of a casing 46 of the belt conveyor device 40. In addition, referring in detail, the tension roller 43 is retained by a pair of tension arms 44 swingably supported by the side plates 461.

The driving roller 42 is placed upstream of the four image forming parts 20Y, 20C, 20M, 20B in the turning direction of the intermediate transfer belt 41. The driving roller 42, supplied with motive power from a drive motor (not shown) via a coaxially mounted driving gear 42*g*, turns the intermediate transfer belt 41 clockwise as in FIG. 2.

The driving roller 42 is placed in adjacency to the secondary transfer part 33. A secondary transfer roller 33*r* is placed in the secondary transfer part 33. The secondary transfer roller 33*r* is set at a position opposed to the driving roller 42 with the intermediate transfer belt 41 pinched interposed therebetween while the secondary transfer roller 33*r* keeps in contact with the outer circumferential surface of the intermediate transfer belt 41.

The tension roller 43 is placed downstream of the four image forming parts 20Y, 20C, 20M, 20B in the turning direction of the intermediate transfer belt 41. As the intermediate transfer belt 41 turns around, the tension roller 43 rotates clockwise in FIG. 2. A pair of bearing members 431 are placed at both end portions, respectively, of the tension roller 43 in its axial direction Dx (drawing-sheet depthwise direction of FIG. 2). Both end portions of a shaft portion 43*x* of the tension roller 43 in the axial direction Dx are inserted into the pair of bearing members 431, respectively.

The tension roller 43 is retained via the bearing members 431 by the pair of tension arms 44 swingably supported by the side plates 461 of the casing 46. The tension roller 43 is biased by the pair of tension springs 45 in such a direction as to get farther from the driving roller 42. In other words, the tension roller 43 is biased by the pair of tension springs 45 in such a direction that tension of the intermediate transfer belt 41 becomes higher. As a result, a specified tension is imparted to the intermediate transfer belt 41.

The pair of tension arms 44 are placed at both end portions, respectively, of the tension roller 43 in the axial direction Dx. The pair of tension arms 44 each extend such that the driving roller 42 and the tension roller 43 get closer to or farther from each other.

A pair of arm support portions 462 are formed on the side plates 461, respectively, of the casing 46. The pair of arm support portions 462 are formed each into a shaft shape extending along the axial direction Dx of the tension roller 43.

Each of the paired tension arms 44 has a hole portion 441 which is placed so as to make the tension roller 43 closer to the driving roller 42 and which extends through in the axial direction Dx of the tension roller 43. By the pair of arm support portions 462 of the casing 46 being inserted into the hole portions 441, respectively, of the tension roller 43, the pair of tension arms 44 are supported by the casing 46 so as to be swingable around an axis line of the pair of arm support portions 462.

Each of the paired tension arms 44 has a container portion 442. The container portion 442 is placed so as to get farther from the driving roller 42 than the hole portion 441. The container portion 442 extends in such a direction as to get farther from the hole portion 441, i.e., from the arm support portion 462 of the casing 46 as well as to become perpendicular to the axial direction Dx of the tension roller 43.

Each container portion 442 contains the bearing member 431 of the tension roller 43 and the tension spring 45. Within each container portion 442, the tension spring 45 and the bearing member 431 are placed in this order as following the hole portion 441 (arm support portion 462). Within the container portion 442, the bearing member 431 is movable in an extending direction of the container portion 442, i.e., in such a direction as to get closer to or farther from the hole portion 441.

The pair of tension springs (biasing members) 45 are contained in the container portions 442 of the pair of tension arms 44, respectively. Each of the paired tension springs 45 is implemented by a compression coil spring as an example, and placed between one hole portion 441 of the paired tension arms 44 and the bearing member 431 of the tension roller 43. Each of the paired tension springs 45 biases the tension roller 43 (more specifically, bearing member 431) in such a direction as to make the tension roller 43 farther from the arm support portion 462. In other words, the pair of tension springs 45 bias the tension roller 43 in such a direction that the tension of the intermediate transfer belt 41 becomes higher.

Figure 10:
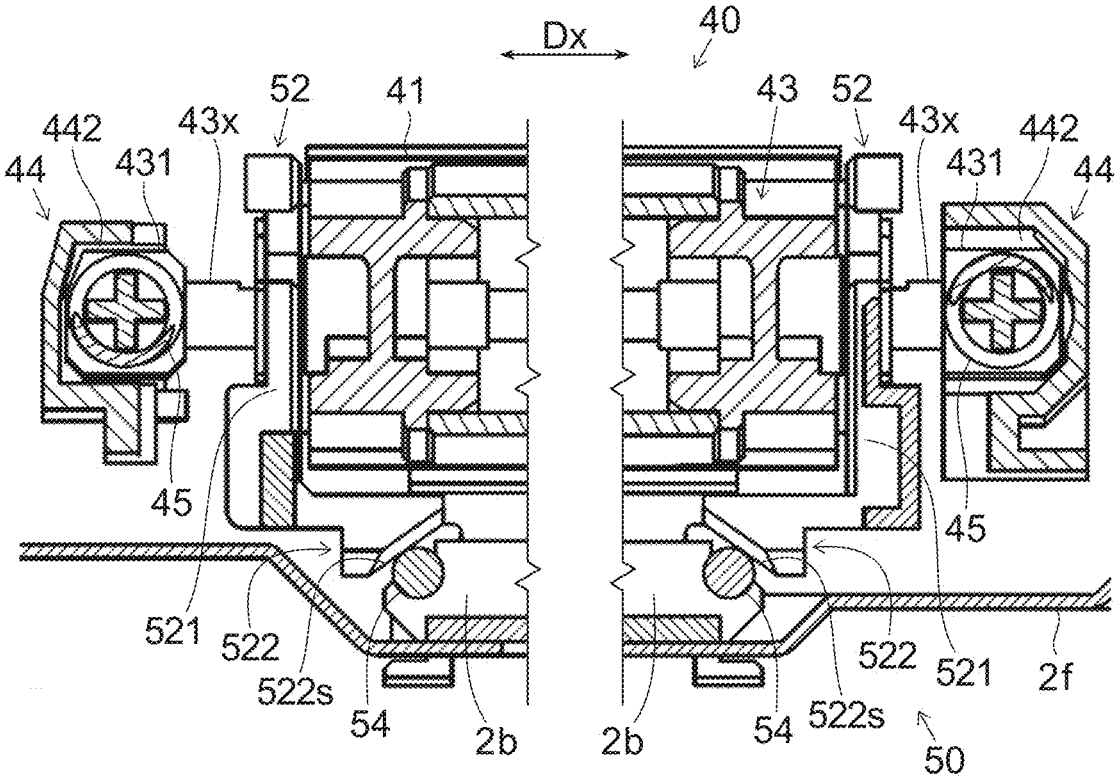
FIG. 10 is a cross-sectional enlarged side view of the belt conveyor device of FIG. 9.
Figure 11:
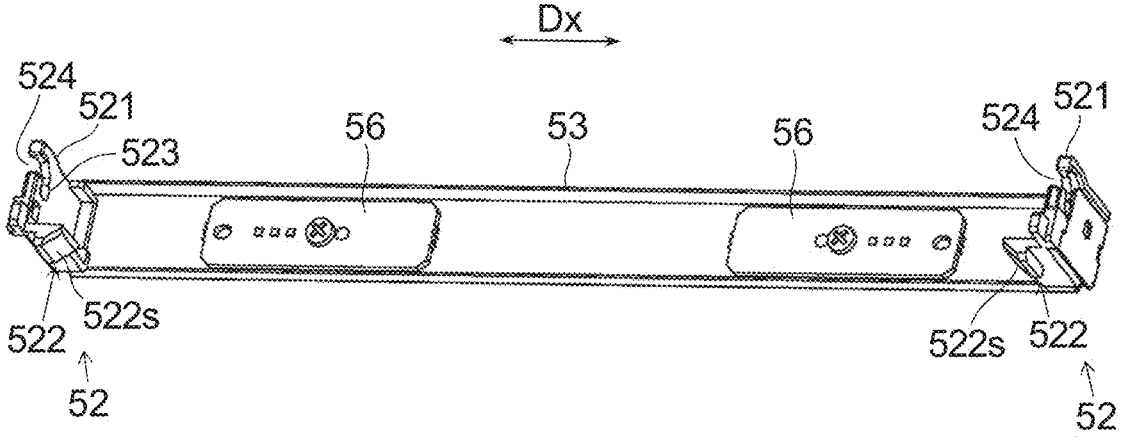
FIG. 11 is a perspective view of inclined bearings and a coupling member in a correction mechanism of FIG. 3.
Figure 12:
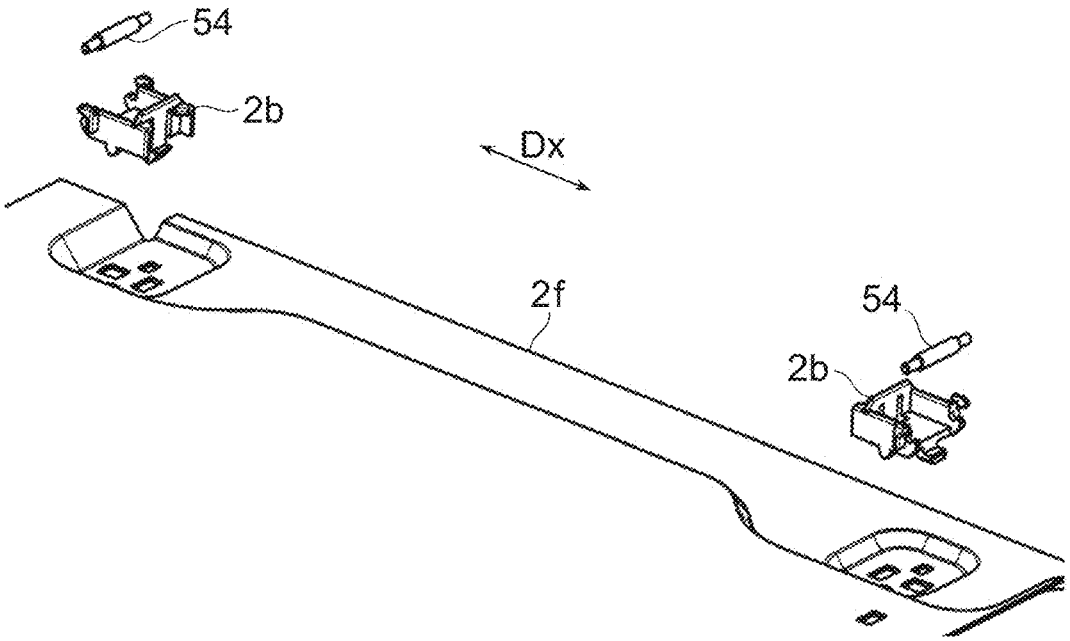
FIG. 12 is an exploded partial perspective view of around main-body guides of the correction mechanism of FIG. 3.
Figure 13:
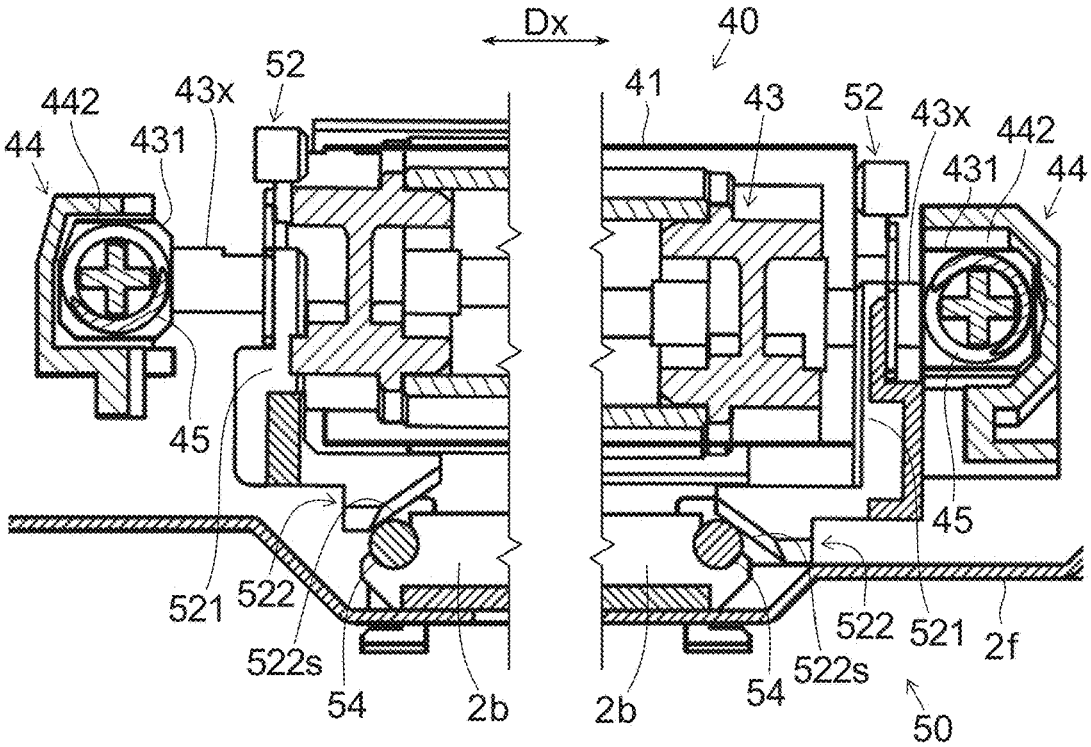
FIG. 13 is a cross-sectional enlarged side view of the belt conveyor device of FIG. 9, showing a state in which the intermediate transfer belt is meandering.

Next, a configuration of around the tension roller 43 of the belt conveyor device 40 will be described with reference to FIGS. 10 to 13. FIG. 10 is a cross-sectional enlarged side view of the belt conveyor device 40 of FIG. 9. FIG. 11 is a perspective view of the inclined bearings and the coupling member in the correction mechanism 50 of the belt conveyor device 40 of FIG. 3. FIG. 12 is an exploded partial perspective view of around main-body guides in the correction mechanism 50 of FIG. 3. FIG. 13 is a cross-sectional enlarged side view of the belt conveyor device 40 of FIG. 9, showing a state in which the intermediate transfer belt 41 is meandering. It is noted that depiction of central part of the tension roller 43 in its axial direction Dx is omitted in FIGS. 10 and 13. Also, in FIG. 12, individual component elements are depicted as exploded upwardly.

The belt conveyor device 40 further includes correction mechanisms 50 shown in FIG. 10. The correction mechanisms 50 are placed at both end portions, respectively, of the tension roller 43 in its axial direction Dx and on an underside of the tension roller 43. The correction mechanisms 50 correct meanders of the intermediate transfer belt 41 relative to the tension roller 43. The correction mechanisms 50 include a pair of inclined bearings 52, a coupling member 53, and a pair of main-body guides 54.

The pair of inclined bearings 52 are placed at both end portions, respectively, of the tension roller 43 in its axial direction Dx. Each of the paired inclined bearings 52 is positioned inside the bearing member 431 of the tension roller 43 relative to the axial direction Dx. Also, each of the paired inclined bearings 52 is positioned outside the intermediate transfer belt 41 relative to the axial direction Dx. Each of the paired inclined bearings 52 is mounted and supported rotatable around an axis line relative to the shaft portion 43*x* of the tension roller 43. The pair of inclined bearings 52 are movable in the axial direction Dx of the tension roller 43.

The coupling member 53 is placed beside the tension roller 43 and radially outside the tension roller 43 so as to be separate from the tension roller 43. The coupling member 53 is a plate-shaped member extending along the vertical or up/down direction as well as the axial direction Dx of the tension roller 43. The coupling member 53 has both end portions in the axial direction Dx of the tension roller 43 connected to the pair of inclined bearings 52, respectively. That is, the coupling member 53 makes the pair of inclined bearings 52 coupled to each other. As a result, in the axial direction Dx of the tension roller 43, the pair of inclined bearings 52 are moved in the same direction and at the same timing.

Also, the pair of inclined bearings 52 include a pair of bearing portions 521 and a pair of inclined portions 522, respectively.

The pair of bearing portions 521 are positioned outside a roller portion of the tension roller 43 and inside the bearing members 431, respectively, in the axial direction Dx of the tension roller 43. Also, the pair of bearing portions 521 are positioned outside the intermediate transfer belt 41 in the axial direction Dx. The shaft portion 43*x* of the tension roller 43 extends through the pair of bearing portions 521 in the axial direction Dx. The pair of bearing portions 521 bear the shaft portion 43*x* of the tension roller 43.

The pair of bearing portions 521 are each formed into a plate shape extending along a direction (radial direction of the tension roller 43) perpendicular to the axial direction Dx of the tension roller 43. An inner surface of the paired bearing portions 521 in the axial direction Dx is opposed, in the axial direction Dx, to both end portions of the intermediate transfer belt 41 in the axial direction Dx. When the intermediate transfer belt 41 meanders, a side end edge of the intermediate transfer belt 41 in its axial direction Dx comes into contact with an inner surface of the paired bearing portions 521.

The pair of inclined portions 522 are placed under the pair of inclined bearings 52, respectively. The pair of inclined portions 522 connect with low ends, respectively, of the pair of bearing portions 521. The pair of inclined portions 522 are positioned inside the pair of bearing portions 521 in the axial direction Dx, as viewed in a direction (e.g., lateral direction) perpendicular to the axial direction Dx of the tension roller 43. Further, the pair of inclined portions 522 are positioned under the tension roller 43, as viewed in a direction perpendicular to the axial direction Dx of the tension roller 43. The pair of inclined portions 522 are opposed to and in contact with the pair of main-body guides 54, respectively.

Each of the paired inclined portions 522 has an inclined surface 522*s*. The inclined surface 522*s* of each of the paired inclined portions 522 is a plane inclined relative to the axial direction Dx of the tension roller 43. More specifically, the inclined surface 522*s* is formed of a plane which is so inclined as to extend from radially central side to outer side (from above to below in FIG. 10) of the tension roller 43 along with a transition from inner to outer side (from central portion to both left/right outer side in FIG. 10) of the axial direction Dx of the tension roller 43. It is noted that individual inclinations of the paired inclined portions 522 are symmetrical with respect to a center portion of the axial direction Dx of the tension roller 43.

The pair of main-body guides 54 are placed at positions vertically opposed to the pair of inclined portions 522, respectively, and fixed to an intermediate frame 2*f* of the housing 2. The pair of main-body guides 54 are placed inside the pair of bearing portions 521 in the axial direction Dx, as viewed in a direction (e.g., lateral direction) perpendicular to the axial direction Dx of the tension roller 43.

In more detail, as shown in FIGS. 10 and 12, the intermediate frame 2*f* includes a pair of base portions 2*b*. The pair of base portions 2*b* are installed at positions of the intermediate frame 2*f* vertically opposed to the pair of inclined portions 522, respectively. The pair of base portions 2*b* support the pair of main-body guides 54, respectively.

Also, the pair of main-body guides 54 are formed of, for example, a pair of cylindrical-shaped members, extending in a direction (drawing-sheet depthwise direction in FIG. 10) perpendicular to the axial direction Dx of the tension roller 43. In other words, the pair of main-body guides 54 extend in such directions that the driving roller 42 and the tension roller 43 get closer to and farther from each other. The pair of main-body guides 54 are opposed to and in contact with the inclined surfaces 522*s* of the pair of inclined portions 522, respectively.

As shown in FIG. 13, when the intermediate transfer belt 41 meanders, the intermediate transfer belt 41 comes into contact with one of the paired inclined bearings 52, pressing the inclined bearing 52 outward (rightward in FIG. 13) of the axial direction Dx. The inclined bearing 52 is moved outward of the axial direction Dx.

As a result, while the inclined bearing 52 slides on the main-body guide 54 via the inclined surface 522*s* of the inclined portion 522, a one-end side (right side in FIG. 13) of the tension roller 43 in its axial direction Dx moves downward is moved downward. That is, the main-body guide 54 makes the one-end side of the tension roller 43 in its axial direction Dx moved in a direction perpendicular to the axial direction Dx (vertically or in the up/down direction) along with the pair of inclined bearings 52 which are moved in the axial direction Dx of the tension roller 43 by meandering of the intermediate transfer belt 41.

Inclination of the tension roller 43 as a whole halts the meandering of the intermediate transfer belt 41. Consequently, the intermediate transfer belt 41 continues to stably turn around.

In addition, in a region of the tension roller 43, since tension is imparted to the intermediate transfer belt 41, the intermediate transfer belt 41 is more likely to meander. Accordingly, providing the tension roller 43 with the correction mechanism 50, which is an alignment control mechanism, makes it possible to improve the performance of halting the meandering of the intermediate transfer belt 41.

As described above, the pair of inclined portions 522 and the pair of main-body guides 54 are placed inside the pair of bearing portions 521 in the axial direction Dx, as viewed in a direction perpendicular to the axial direction Dx of the tension roller 43. With this configuration, the pair of inclined portions 522 and the pair of main-body guides 54 in the correction mechanism 50 that makes the tension roller 43 inclined are not positioned outside both end portions of the tension roller 43 in the axial direction Dx. That is, the belt conveyor device 40 can be downsized in the axial direction Dx of the tension roller 43. Therefore, the belt conveyor device 40, while provided in a downsized configuration, is enabled to halt the meandering of the intermediate transfer belt 41.

In more detail, as shown in FIG. 10, the pair of inclined portions 522 and the pair of main-body guides 54 are placed inside both end portions of the intermediate transfer belt 41 in the axial direction Dx, as viewed in a direction perpendicular to the axial direction Dx of the tension roller 43.

With the above-described configuration, the pair of inclined portions 522 and the pair of main-body guides 54 are placed closer to central portion of the tension roller 43 in the axial direction Dx than the pair of bearing portions 521 with which the meandering intermediate transfer belt 41 comes into contact. As a result of this, moving extent of a one-end side of the tension roller 43 in a direction (vertical or up/down direction) perpendicular to the axial direction Dx can be made larger than outward moving extent of the inclined bearings 52 in the axial direction Dx. Accordingly, the belt conveyor device 40, while provided in a downsized configuration, is enabled to halt meandering of the intermediate transfer belt 41 more effectively.

Also as described above, the pair of inclined portions 522 and the pair of main-body guides 54 are placed below the tension roller 43 supported by the pair of inclined bearings 52. Further, the pair of main-body guides 54 are placed below the pair of inclined portions 522. Gravitational action on the tension roller 43 causes the pair of inclined bearings 52 to be pressed against the pair of main-body guides 54. While the intermediate transfer belt 41 turns around normally without meandering, the shaft portion 43*x* of the tension roller 43 keeps generally horizontal. While the intermediate transfer belt 41 is normally turning around, the state of FIG. 10 is maintained.

With the above-described configuration, exploiting gravitational action on the tension roller 43 allows the pair of inclined portions 522 and the pair of main-body guides 54 to be easily put into and kept in contact with each other. As a result of this, there is no need for any biasing member that yields biasing force by which the pair of inclined portions 522 and the pair of main-body guides 54 are brought closer to and into contact with each other. Accordingly, the correction mechanism 50 can be provided in a convenient configuration, allowing the belt conveyor device 40 to be downsized to more extent.

Also as shown in FIG. 8, along with turning of the intermediate transfer belt 41, the tension roller 43 is rotated in such a direction that a portion of the intermediate transfer belt 41 kept in contact with the tension roller 43 is moved from upper toward lower side. That is, referring to FIG. 8, the tension roller 43 is rotated clockwise. Then, as far as a vicinity of the tension roller 43 is concerned, the pair of inclined portions 522 and the pair of main-body guides 54 are placed downstream of a contact portion of the intermediate transfer belt 41 kept in contact with the tension roller 43 supported by the pair of inclined bearings 52, as viewed in a moving direction of the intermediate transfer belt 41.

With the above-described configuration, by movement of the portion of the intermediate transfer belt 41 that is kept in contact with the tension roller 43, torque is generated around an axis line of the tension roller 43. The torque is generated toward the downstream side in the moving direction of the portion of the intermediate transfer belt 41 that is kept in contact with the tension roller 43. That is, force generated around the axis line of the tension roller 43 by the movement of the intermediate transfer belt 41 acts in a direction of thrusting the pair of inclined portions 522 toward the pair of main-body guides 54. As a result of this, there is no need for any biasing member that yields biasing force by which the pair of inclined portions 522 and the pair of main-body guides 54 are brought closer to and into contact with each other.

Also as shown in FIG. 8, the pair of arm support portions 462 for supporting the pair of tension arms 44 aimed at enhancing tension of the intermediate transfer belt 41 are placed above the shaft portion 43*x* of the tension roller 43. That is, the pair of tension springs 45 bias the tension roller 43 in such a direction as to make the tension roller 43 farther from the arm support portions 462, thus making the biasing force act downward relative to the arm support portions 462.

With the above-described configuration, the biasing force for the tension roller 43 by the pair of tension springs 45 acts in a direction of thrusting the pair of inclined portions 522 toward the pair of main-body guides 54. As a result of this, there is no need for any biasing member that yields biasing force by which the pair of inclined portions 522 and the pair of main-body guides 54 are brought closer to and into contact with each other. Accordingly, the correction mechanism 50 can be provided in a convenient configuration, allowing the belt conveyor device 40 to be downsized to more extent.

Each of the tension arms 44 has the container portion 442 for containing the bearing member 431 of the tension roller 43 and the tension spring 45. With this configuration, the tension roller 43 can be biased in a specified direction along the extending direction of the container portion 442 by the tension springs 45. It becomes achievable to effectively enhance the tension of the intermediate transfer belt 41.

Thus, it also becomes implementable to improve transfer performance in primary transfer and secondary transfer of toner images.

Furthermore, as described above, each of the paired inclined portions 522 has the inclined surface 522*s*, while each of the paired main-body guides 54 is formed from a cylindrical-shaped member. In other words, the pair of main-body guides 54 have contact regions with the pair of inclined portions 522, respectively, which are formed from curved surfaces convex toward the pair of inclined portions 522, as viewed in a direction (lateral direction) perpendicular to the axial direction Dx of the tension roller 43, respectively.

Figure 14:
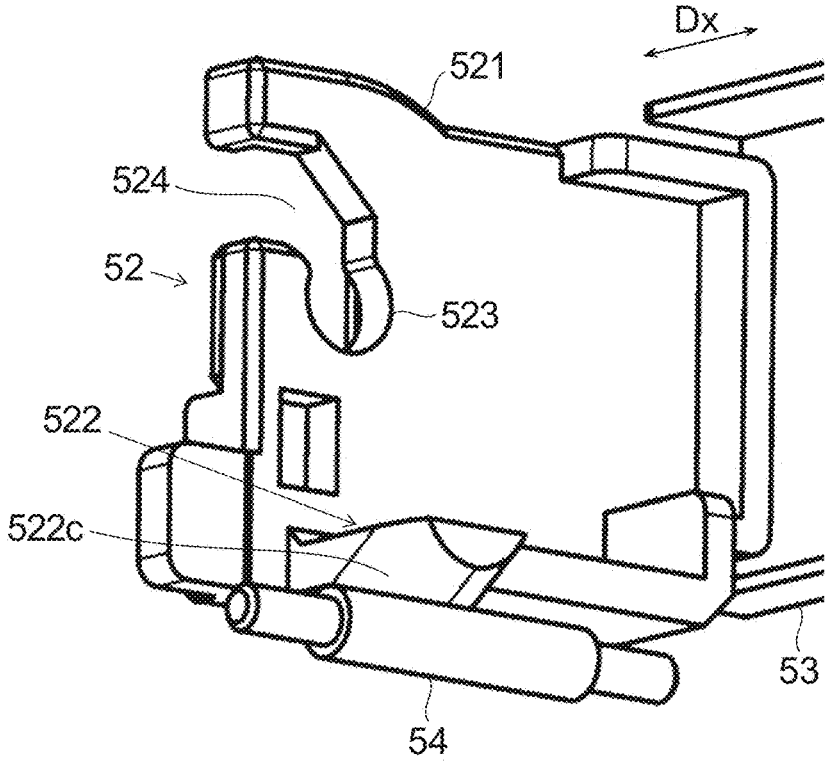
FIG. 14 is a perspective view of an inclined bearing and a main-body guide in a belt conveyor device according to Modification 1.
Figure 15:
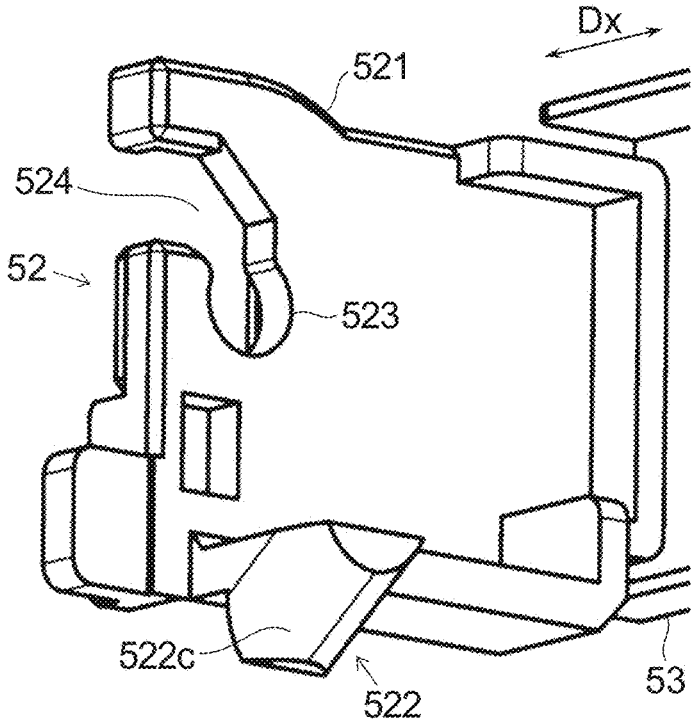
FIG. 15 is a perspective view of the inclined bearing of FIG. 14.

FIG. 14 is a perspective view of an inclined bearing 52 and a main-body guide 54 in a belt conveyor device 40 according to Modification 1. FIG. 15 is a perspective view of the inclined bearing 52 of FIG. 14. As shown as Modification 1 in FIGS. 14 and 15, each of the paired inclined portions 522 has a curved surface 522*c*.

A ridge line of the curved surface 522*c*, as viewed in a direction (lateral direction) perpendicular to the axial direction Dx of the tension roller 43, is formed of a straight line which is so inclined as to be directed from radially central side toward outer side (from above to below in FIGS. 14 and 15) of the tension roller 43 along with a transition from inner side (central portion) toward outer side in the axial direction Dx of the tension roller 43. The pair of inclined portions 522 have contact regions with the pair of main-body guides 54, respectively, the contact regions being formed from the curved surfaces 522*c* convex toward the pair of main-body guides 54, as viewed in a direction (lateral direction) perpendicular to the axial direction Dx of the tension roller 43, respectively.

As described above, each contact region of one with the other, whichever the one is either the pair of inclined portions 522 or the pair of main-body guides 54, is formed from a curved surface which is convex toward the other being in contact with the one, as viewed in a direction perpendicular to the axial direction Dx of the tension roller 43. With this configuration, the contact regions between the pair of inclined portions 522 and the pair of main-body guides 54 can be reduced. That is, frictional force generated between the pair of inclined portions 522 and the pair of main-body guides 54 can be reduced. Consequently, wear of the pair of inclined portions 522 and the pair of main-body guides 54 can be suppressed, so that the performance of halting meanders of the intermediate transfer belt 41 can be maintained preferable.

Furthermore, since the pair of main-body guides 54 are formed each into a cylindrical shape, it becomes easily achievable to form the pair of main-body guides 54 that are aimed at reducing the contact regions with the pair of inclined portions 522. Accordingly, the correction mechanism 50 can be provided in a convenient configuration, allowing the belt conveyor device 40 to be downsized to more extent.

In addition, the contact regions of the pair of inclined portions 522 with the pair of main-body guides 54 may be formed each in a cylindrical shape. Also, an inclined portion having a curved surface may be formed in each contact regions of the pair of main-body guides 54 with the pair of inclined portions 522.

Further, each of the paired main-body guides 54 formed from a cylindrical-shaped member may be a rotating member that rotates around an axis line extending in a direction perpendicular to the axial direction Dx of the tension roller 43.

Figure 16:
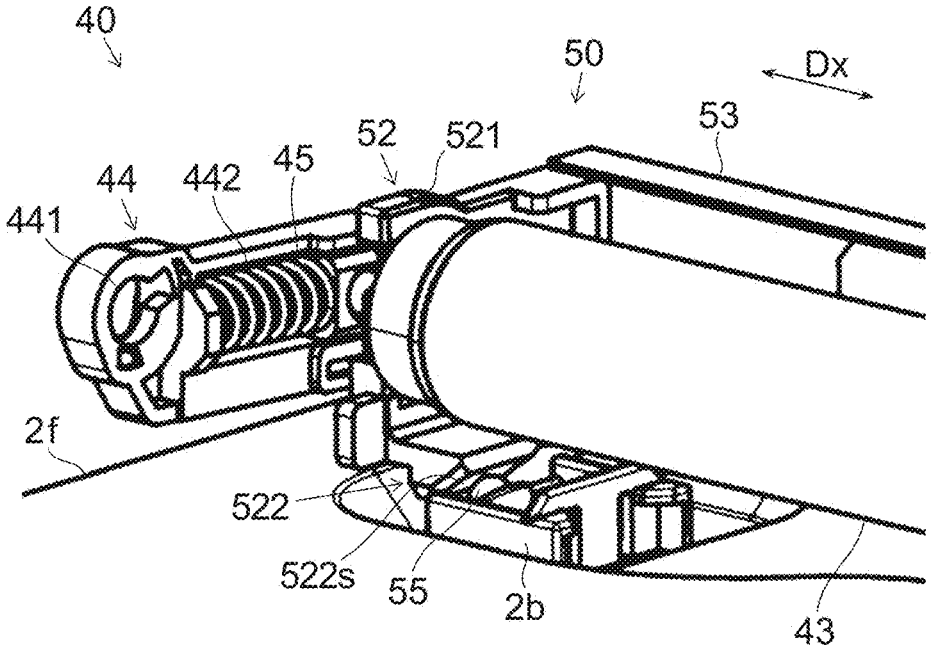
FIG. 16 is a perspective view of an inclined bearing and a main-body guide in a belt conveyor device according to Modification 2.
Figure 17:
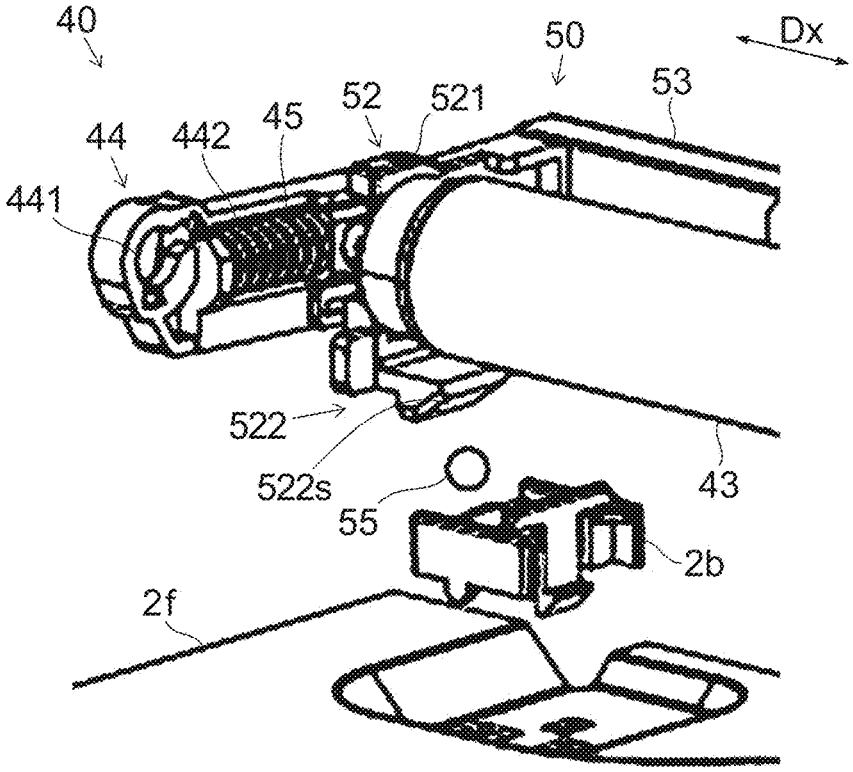
FIG. 17 is an exploded perspective view of the inclined bearing and the main-body guide of FIG. 16.

FIG. 16 is a perspective view of an inclined bearing 52 and a main-body guide 55 in a belt conveyor device 40 according to Modification 2. FIG. 17 is an exploded perspective view of around the main-body guide 55 of FIG. 16. In FIG. 17, the main-body guide 55 and the base portion 2*b* are depicted as exploded upward. Each of the paired main-body guides 55 is formed from sphere member as shown in FIGS. 16 and 17 as Modification 2.

Each of the paired main-body guides 55 formed from a sphere member is a rotating member that rotates around at least an axis line extending in a direction perpendicular to the axial direction Dx of the tension roller 43 relative to the pair of base portions 2*b*. The pair of main-body guides 55 are opposed to and in contact with the inclined surfaces 522*s*, respectively, of the pair of inclined portions 522.

In addition, a rotating member that rotates around an axis line extending in a direction perpendicular to the axial direction Dx may be provided in each contact region of the pair of inclined portions 522 with the pair of main-body guides. As shown in this case, in either one of the paired inclined portions 522 or the paired main-body guides 54, 55, the contact region with the other is formed of a rotating member that rotates around an axis line extending in a direction perpendicular to the axial direction Dx of the tension roller 43.

With the above-described configuration, the contact regions between the pair of inclined portions 522 and the pair of main-body guides 54, 55 can be made to feature rolling friction. Since rolling friction is much smaller in frictional force than sliding friction, a frictional load involved can be alleviated. Alleviated frictional loads allow the wear of the pair of inclined portions 522 and the pair of main-body guides 54, 55 to be suppressed, so that the performance of halting meanders of the intermediate transfer belt 41 can be maintained preferable.

Figure 18:
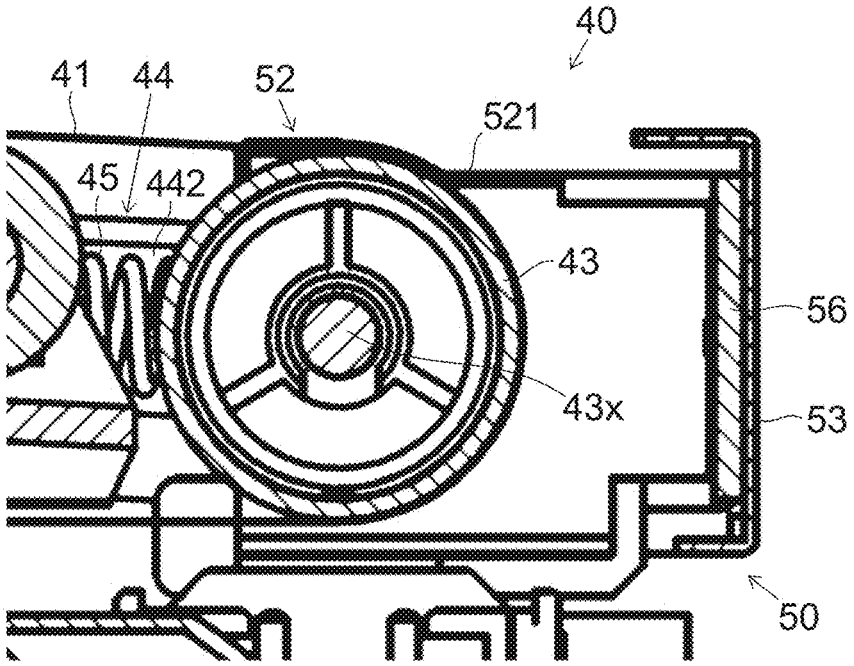
FIG. 18 is a cross-sectional partial front view of around the tension roller of FIG. 3.
Figure 19:
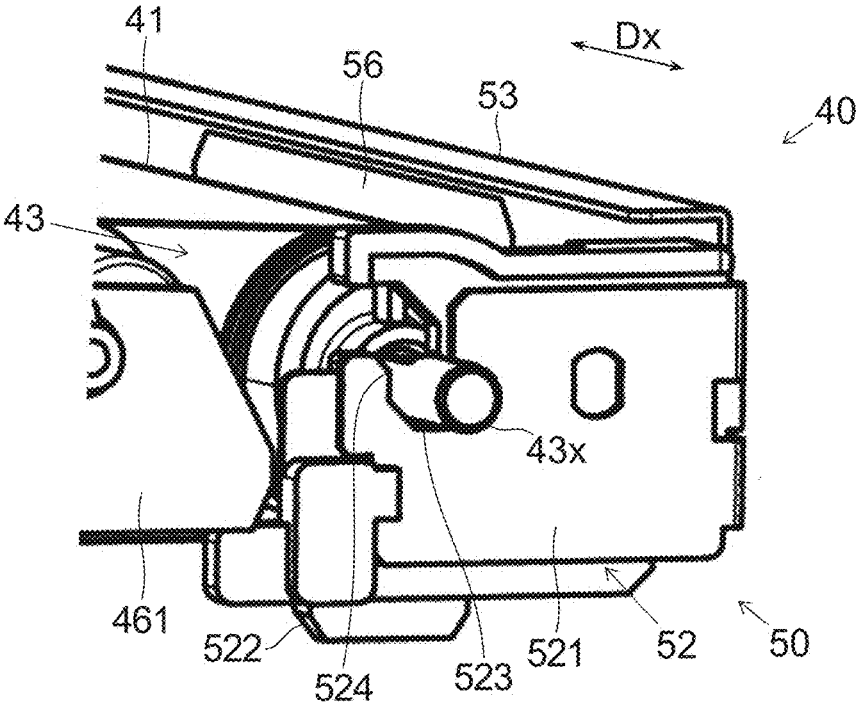
FIG. 19 is a partial perspective view of around the tension roller of FIG. 3, showing a state in which a tension arm has been removed.
Figure 20:
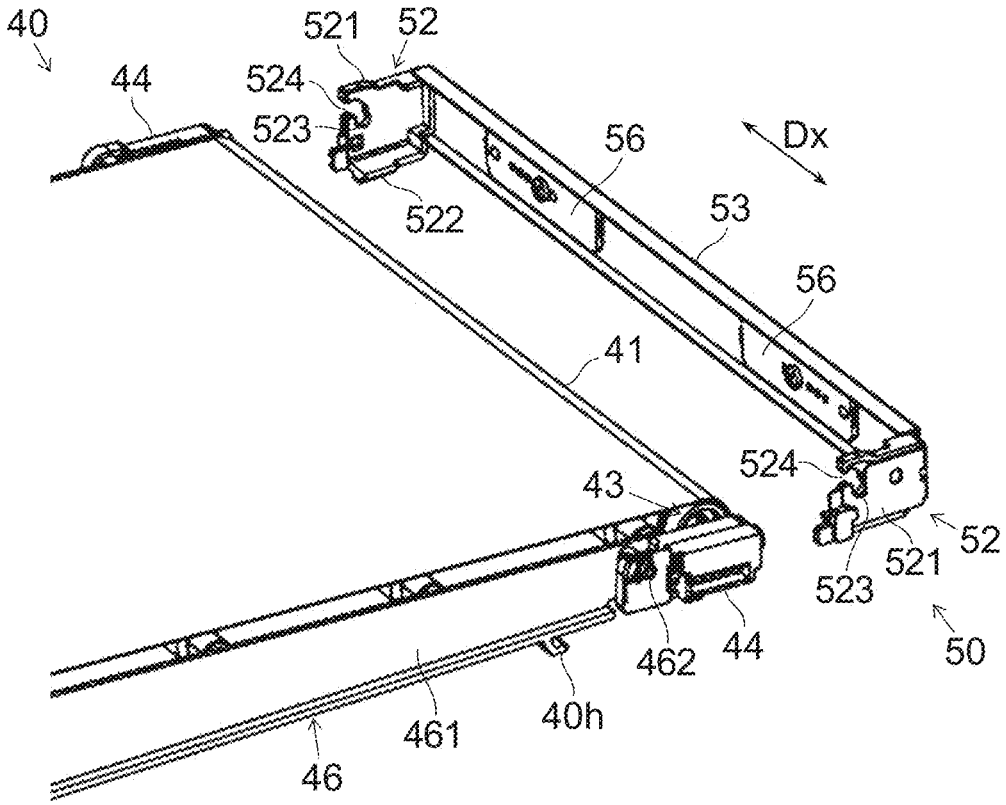
FIG. 20 is a partial perspective view of around the tension roller of FIG. 3, showing a state in which the inclined bearings and the coupling member of the correction mechanism have been removed.

FIG. 18 is a cross-sectional partial front view of around the tension roller 43 of FIG. 3. FIG. 19 is a partial perspective view of around the tension roller 43 of FIG. 3, showing a state in which the tension arm 44 has been removed. FIG. 20 is a partial perspective view of around the tension roller of FIG. 3, showing a state in which the inclined bearings 52 and the coupling member 53 of the correction mechanism 50 have been removed.

Each of the paired inclined bearings 52 further includes a through portion 523 and a groove portion 524. The through portion 523 and the groove portion 524 are formed in each of the paired bearing portions 521.

The through portion 523 is placed at a position opposed to the shaft portion 43*x* of the tension roller 43 as viewed in the axial direction Dx of the tension roller 43. The through portion 523 is formed of a hole portion extending through the bearing portion 521 in the axial direction Dx. The shaft portion 43*x* of the tension roller 43 is inserted into the through portion 523.

The groove portion 524 extends from the through portion 523 in a direction perpendicular to the axial direction Dx. More specifically, the groove portion 524 extends upward from the through portion 523 toward the arm support portion 462 side of the casing 46 (toward the driving roller 42 side relative to the tension roller 43). Then, the groove portion 524 is opened at an end edge of the bearing portion 521.

With the above-described configuration of the through portion 523 and the groove portion 524, the shaft portion 43*x* of the tension roller 43 can be inserted and withdrawn through the groove portion 524 between external of the bearing portion 521 and the through portion 523. That is, as shown in FIG. 20, the pair of inclined bearings 52 are fittable to and removable from the shaft portion 43*x* of the tension roller 43.

The pair of inclined bearings 52 become more easily replaceable by virtue of their being fittable to and removable from the shaft portion 43*x* of the tension roller 43. That is, for example, when the pair of inclined portions 522 have worn out, the pair of inclined bearings 52 can be easily replaced. Accordingly, the performance of halting meanders of the intermediate transfer belt 41 can be maintained preferable.

In addition, the pair of inclined bearings 52 are coupled to each other by the coupling member 53, being integrally fittable to and removable from the shaft portion 43*x* of the tension roller 43. That is, the pair of inclined bearings 52 placed at both end portions, respectively, of the tension roller 43 in the axial direction Dx are fittable to and removable from the shaft portion 43*x* simultaneously. As a result of this, improvement of workability can be fulfilled for replacement of the pair of inclined bearings 52.

Also, the coupling member 53 includes concentration sensors 56. The concentration sensors 56 are fitted to a side face of the coupling member 53, which is a plate-shaped member extending along the axial direction Dx. The concentration sensors 56 are placed opposite the outer circumferential surface of the intermediate transfer belt 41.

Each concentration sensor 56 is formed of a reflection-type optical sensor having a light emitting part including an LED (Light Emitting Diode) or other light emitting element, and a light receiving part including a photodiode or other light receiving element. The light emitting part emits detection light at a specified angle toward a toner image which has been primarily transferred onto the outer circumferential surface of the intermediate transfer belt 41. The light receiving part receives detection light that has been emitted by the light emitting part toward a toner image and reflected by the toner image.

Each concentration sensor 56 outputs a level of detection light received by the light receiving part, as a detection value (voltage value) corresponding to a toner concentration, from which a toner quantity of a toner image primarily transferred onto the outer circumferential surface of the intermediate transfer belt 41 can be derived and the toner concentration of the toner image can be detected. For example, with no toner present on the outer circumferential surface of the intermediate transfer belt 41, detection light emitted from the light emitting part is not diffusely reflected but regularly reflected by the toner, and let to go incident more largely on the light receiving part. As a result, the detection value (voltage value) corresponding to the toner image is heightened. Then, the more the toner quantity on the outer circumferential surface of the intermediate transfer belt 41 increases, the larger the quantity of light is diffusely reflected by the toner, so that the quantity of light going incident on the light receiving part decreases gradually. As a result of this, the detection value (voltage value) corresponding to the toner image lowers gradually.

With the above-described configuration, the concentration sensor 56 is inclined by subordinately trailing inclinations of the whole tension roller 43 by the correction mechanism 50. That is, even when the intermediate transfer belt 41 meanders so that the tension roller 43 is wholly inclined, the concentration sensors 56 are kept from changing in relative position to the outer circumferential surface of the intermediate transfer belt 41. Accordingly, detection accuracy for toner concentration by the concentration sensors 56 can be stabilized, and maintained preferable to more extent. Further, since the coupling member 53 is fittable to and removable from the shaft portion 43*x* of the tension roller 43, the concentration sensors 56 are easily replaceable, for example, upon occurrence of failures.

Although an embodiment of this disclosure has been fully described hereinabove, yet the disclosure is not limited to the scope of this description and may be modified in various ways unless those modifications depart from the gist of the disclosure.

For instance, in the above embodiment, the belt conveyor device 40 is configured to include the intermediate transfer belt 41 to which toner images formed by the four image forming parts 20 are transferred successively in superimposition. However, the intermediate transfer belt 41 is not limited to such a device. The disclosure is applicable also to a belt conveyor device including a conveyor belt for conveying a recording medium on which images are recorded by an image forming apparatus, as an example. In this case, the belt conveyor device is enabled to halt meanders of the conveyor belt for conveying the recording medium with a configuration aimed at downsizing.

Also in the above embodiment, the image forming apparatus 1 is described as a so-called tandem-type image forming apparatus for color printing. However, the image forming apparatus is not limited to such models. The image forming apparatus, as long as it includes an intermediate transfer belt, may be a color-printing image forming apparatus of any type other than the tandem type.

What is claimed is:

1. A belt conveyor device comprising:

a casing;

an endless belt;

a plurality of rollers which is rotatably supported by the casing and on which the belt is stretched turnable;

a pair of biasing members for biasing a tension roller out of the plural rollers in such a direction as to heighten tension of the belt;

a pair of tension arms which are swingably supported by the casing and which retain the tension roller and the pair of biasing members; and a correction mechanism for correcting meanders of the belt relative to the rollers, wherein the correction mechanism includes:

a pair of inclined bearings including a pair of bearing portions for bearing a shaft portion of the tension roller, and further including a pair of inclined portions that are inclined symmetrically with respect to an axial direction of the tension roller, where the pair of inclined bearings rotatably support the shaft portion of the tension roller, and are movable in the axial direction; and a pair of main-body guides which are put into contact with the pair of inclined portions, respectively, and which make an end portion of the tension roller in the axial direction moved in a direction perpendicular to the axial direction, together with the pair of inclined bearings that are moved in the axial direction by meandering of the belt, the pair of main-body guides are placed below the pair of inclined portions and are respectively in contact with the pair of inclined portions from below, the casing is placed separate from the tension roller, and includes a pair of arm support portions each formed in a shaft shape extending along the axial direction of the tension roller, the pair of tension arms are swingably supported by the pair of arm support portions, respectively, formed in the casing, the pair of biasing members bias the shaft portion of the tension roller in such a direction as to make the tension roller farther from the pair of arm support portions, and the pair of arm support portions are placed above the shaft portion of the tension roller.

2. The belt conveyor device according to claim 1, further comprising a pair of bearing members which are placed both end portions, respectively, of the tension roller in the axial direction and into which the shaft portion of the tension roller is inserted, wherein the pair of tension arms each has a container portion which extends in a direction perpendicular to the axial direction and which contains the bearing members and the biasing members.

3. An image forming apparatus comprising:

a plurality of image forming parts; and the belt conveyor device according to claim 1 which is placed in adjacency to the image forming parts and which conveys a recording medium on which images are recorded by the image forming parts.

4. An image forming apparatus comprising:

a plurality of image forming parts; and the belt conveyor device according to claim 1 which is placed in adjacency to the image forming parts and the belt of which is an intermediate transfer belt to which toner images formed by the image forming parts are transferred successively in superimposition.

* * * * *